US008522462B2

(12) United States Patent
Lukas et al.

(10) Patent No.: US 8,522,462 B2
(45) Date of Patent: Sep. 3, 2013

(54) PIEZOELECTRIC PUMP FOR HOUSEHOLD ELECTRIC APPLIANCE

(75) Inventors: Andrea Lukas, Offenbach (DE); Björn Scheve, Reichelsheim (DE); Matthias Hahn, Frankfurt (DE)

(73) Assignee: Rowenta Werke GmbH (DE)

( * ) Notice: Subject to any disclaimer, the term of this patent is extended or adjusted under 35 U.S.C. 154(b) by 68 days.

(21) Appl. No.: 13/139,071

(22) PCT Filed: Nov. 30, 2009

(86) PCT No.: PCT/IB2009/007607

§ 371 (c)(1),
(2), (4) Date: Aug. 25, 2011

(87) PCT Pub. No.: WO2010/067157

PCT Pub. Date: Jun. 17, 2010

(65) Prior Publication Data

US 2011/0296722 A1 Dec. 8, 2011

(30) Foreign Application Priority Data

Dec. 10, 2008 (FR) ..... 08 06930

(51) Int. Cl.
*D06F 75/18* (2006.01)
*D06F 75/08* (2006.01)

(52) U.S. Cl.
USPC ..... 38/77.8; 417/413.2

(58) Field of Classification Search
USPC ..... 38/74, 77.8; 417/413.2
See application file for complete search history.

(56) References Cited

U.S. PATENT DOCUMENTS

| | | | | |
|---|---|---|---|---|
| 2,504,493 | A * | 4/1950 | Brownshield | 310/356 |
| 4,420,706 | A * | 12/1983 | Siebold et al. | 310/324 |
| 4,545,561 | A * | 10/1985 | Brown | 251/129.08 |
| 4,648,807 | A | 3/1987 | Tippetts et al. | |
| 4,705,982 | A * | 11/1987 | Besson et al. | 310/356 |
| 5,787,614 | A * | 8/1998 | Stutzer | 38/77.1 |
| 6,450,419 | B1 * | 9/2002 | Martens et al. | 239/102.1 |
| 6,589,229 | B1 | 7/2003 | Connelly et al. | |
| 6,843,430 | B2 * | 1/2005 | Boticki et al. | 239/102.1 |
| 2002/0000054 | A1 * | 1/2002 | Rienzo et al. | 38/74 |
| 2007/0267940 | A1 | 11/2007 | Wright | |
| 2011/0308650 | A1 * | 12/2011 | Amirouche et al. | 137/565.13 |

FOREIGN PATENT DOCUMENTS

| | | | |
|---|---|---|---|
| ep | 0496629 | A1 | 7/1992 |
| EP | 1177802 | A1 | 2/2002 |
| JP | 62142597 | A | 6/1987 |

* cited by examiner

*Primary Examiner* — Ismael Izaguirre
(74) *Attorney, Agent, or Firm* — The Webb Law Firm

(57) ABSTRACT

Piezoelectric pump for a household electric appliance having a moving wall interposed between a first casing element defining a pumping chamber with the moving wall, and a second casing element applying pressure to the periphery of the moving wall in order to hold the latter in position. The moving wall has an exterior face in contact with a piezoelectric actuator designed to cause the moving wall to move so as to bring about a periodic variation in the volume of the pumping chamber under the action of the piezoelectric actuator wherein the first casing element and the second casing element are held together under stress by an elastic clip, the elastic clip applying a pressure that tends to compress the first casing element onto the second casing element.

11 Claims, 5 Drawing Sheets

PIEZOELECTRIC PUMP FOR HOUSEHOLD ELECTRIC APPLIANCE

BACKGROUND OF THE INVENTION

1. Field of the Invention

The present invention relates to a piezoelectric pump for a household electric appliance and more particularly relates to a piezoelectric pump comprising a moving wall interposed between a first casing element, defining a pumping chamber with the moving wall, and a second casing element applying pressure to the periphery of the moving wall in order to hold the latter in position.

2. Description of Related Art

Japanese patent application #62142597 discloses a clothing iron comprising a piezoelectric pump that supplies a vaporization chamber with water from a receptacle. This document describes a piezoelectric pump comprising a moving wall interposed between a first element, defining a pumping chamber with the moving wall, and a second element applying pressure to the periphery of the mobile wall in order to hold the latter in position.

In a customary fashion, the first and second casing elements are fastened together by gluing, screwing, or ultrasound welding. Such assembly means, however, have the disadvantage of allowing a certain degree of relaxation of the pump elements over time, particular under the effect of temperature fluctuations. This phenomenon is accentuated when the elements of the piezoelectric pump are made of plastic.

The performance of a piezoelectric pump is closely linked to the dimensions of the pumping chamber. Hence the phenomenon of relaxation of the means for assembling the various parts of the casing can lead to a significant decline in pump performance. These same factors make it equally difficult to mass produce piezoelectric pumps with uniform performance characteristics.

SUMMARY OF THE INVENTION

Hence an object of this invention is to remedy these disadvantages by proposing a piezoelectric pump in which the assembly of the pump elements makes it possible to obtain a pumping chamber with stable performance characteristics over time.

To this end, the object of the invention is a piezoelectric pump for a household electric appliance comprising a moving wall interposed between a first casing element, defining a pumping chamber with the moving wall, and a second casing element applying pressure to the periphery of the moving wall in order to hold the latter in position, said moving wall comprising an exterior face in contact with a piezoelectric actuator designed to cause said moving wall to move so as to bring about a periodic variation in the volume of the pumping chamber by means of said piezoelectric actuator, characterized in that said first casing element and said second casing element are held together under stress by means of an elastic clip applying a pressure that tends to compress said first casing element onto said second casing element.

According to another characteristic of the invention, a gasket is interposed between the moving wall and the first casing element.

According to still another characteristic of the invention, the second casing element comprises a raised portion that applies pressure to the moving wall opposite the gasket, thus sandwiching the periphery of said moving wall between said gasket and said raised portion.

According to still another characteristic of the invention, the moving wall comprises a bottom face coated with at least one electrically insulating adhesive film that extends radially beyond the moving wall and has a peripheral rim glued onto the second casing element.

According to another characteristic of the invention, the elastic clip comprises a part that exerts pressure on the second casing element, in the zone opposite the pumping chamber.

According to another characteristic of the invention, the elastic clip comprises at least one end with a gripping tab.

According to another characteristic of the invention, the elastic clip consists of a springy metal band.

According to another characteristic of the invention, the first and second casing elements comprise complementary shapes that ensure their correct relative positioning during the assembly of the pump by means of the elastic clip.

According to another characteristic of the invention, the piezoelectric pump comprises a third element covering the first element oppositely disposed relative to the second element, said third element comprising a delivery line and a discharge line communicating with an inlet and an outlet, respectively, of the pumping chamber.

According to another characteristic of the invention, the first and third elements comprise complementary shapes that ensure their correct relative positioning during the assembly of the piezoelectric pump by means of the elastic clip.

According to another characteristic of the invention, the elastic clip presses on the second and third elements.

The invention further relates to a clothing iron comprising means for supplying water to a spray nozzle or to a vaporization chamber, characterized in that said supply means comprise a piezoelectric pump as described above.

BRIEF DESCRIPTION OF THE DRAWINGS

The objects, aspects, and advantages of the present invention will emerge more clearly from the following description of an illustrative embodiment of the invention provided as a nonlimiting example, with reference to the appended drawings, in which.

DETAILED DESCRIPTION OF THE INVENTION

Only the elements needed for understanding the invention have been shown. To make the drawings easier to read, the same elements have the same reference numbers from figure to figure.

Figure 1:
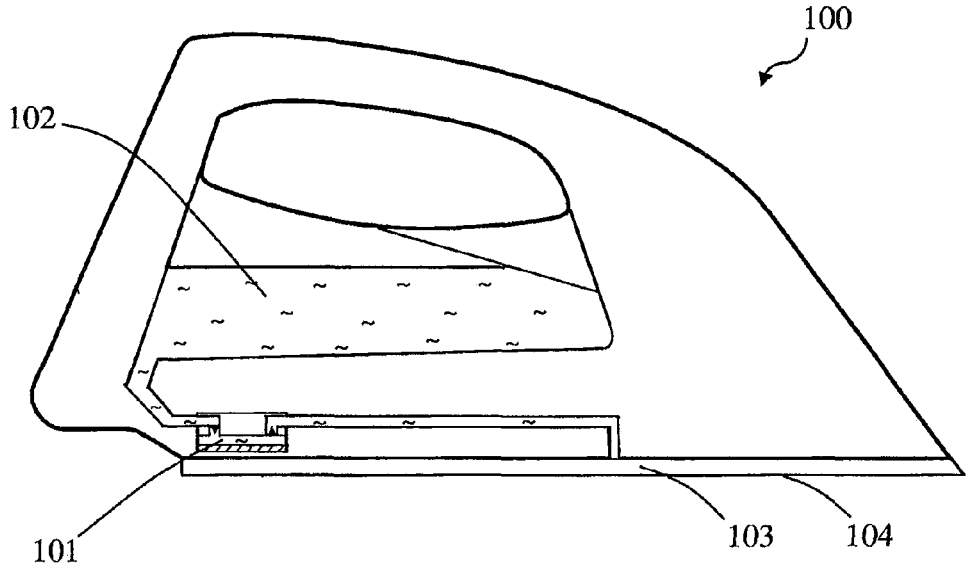
FIG. 1 is a schematic cutaway view of a clothing iron equipped with a pump according to a first embodiment of the invention.

FIG. 1 is a schematic illustration of a clothing iron 100 comprising a heating sole 104 that includes a vaporization chamber 103 supplied with water by a piezoelectric pump 101 connected to a receptacle 102.

Figure 2:
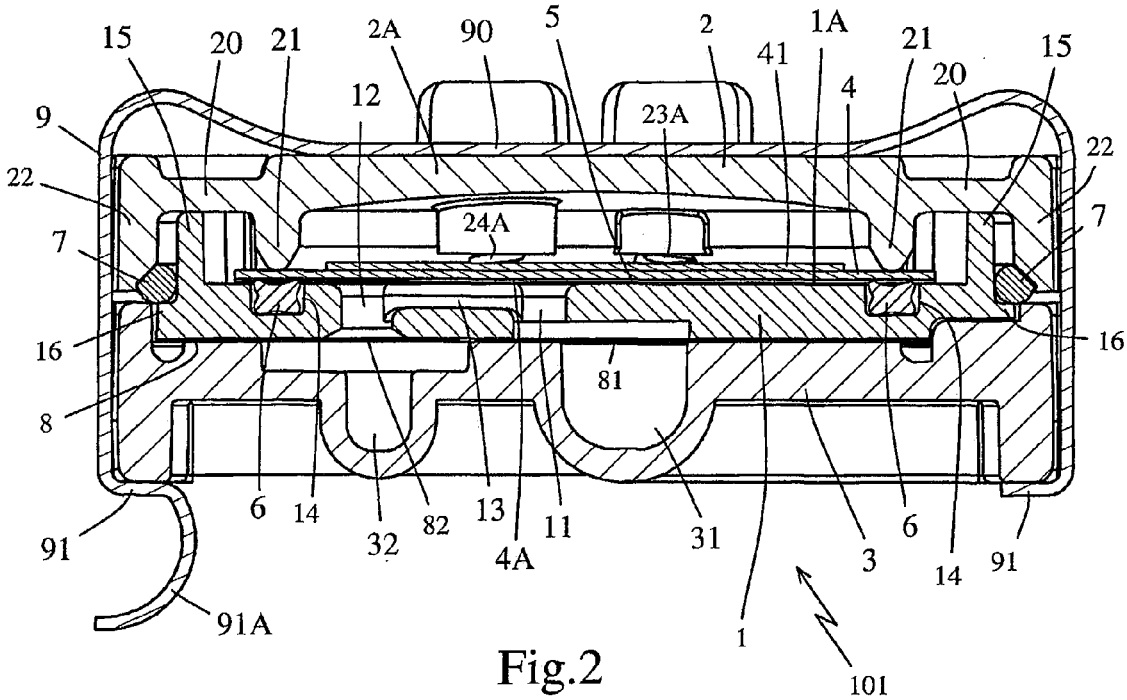
FIG. 2 is a cutaway view of the piezoelectric pump of the appliance of FIG. 1.
Figure 3:
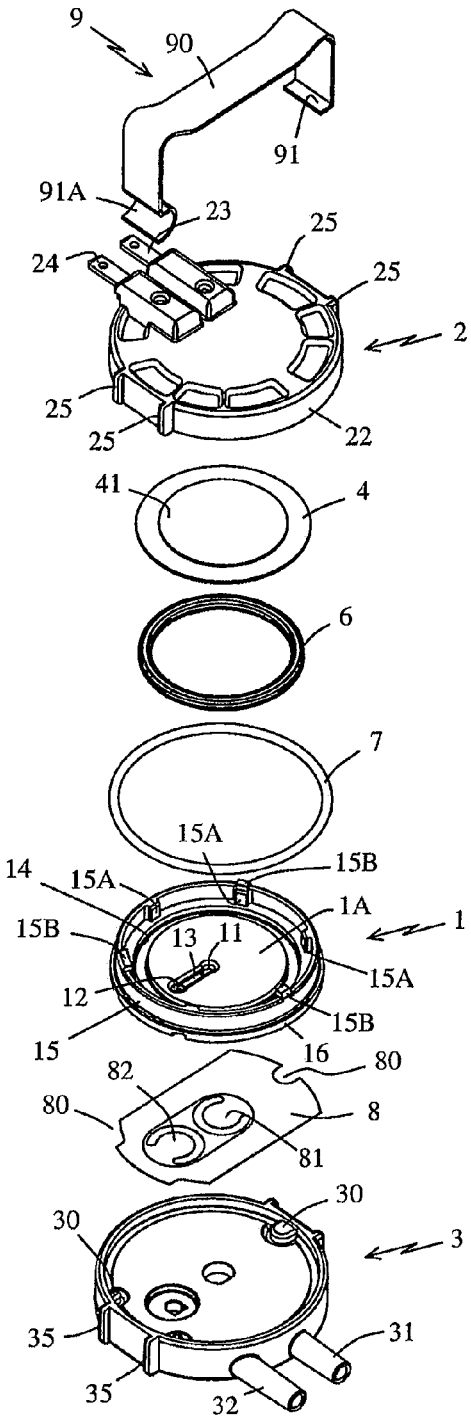
FIGS. 3 and 4 are exploded perspective views of the piezoelectric pump of FIG. 2, as viewed from above and viewed from below, respectively.
Figure 4:
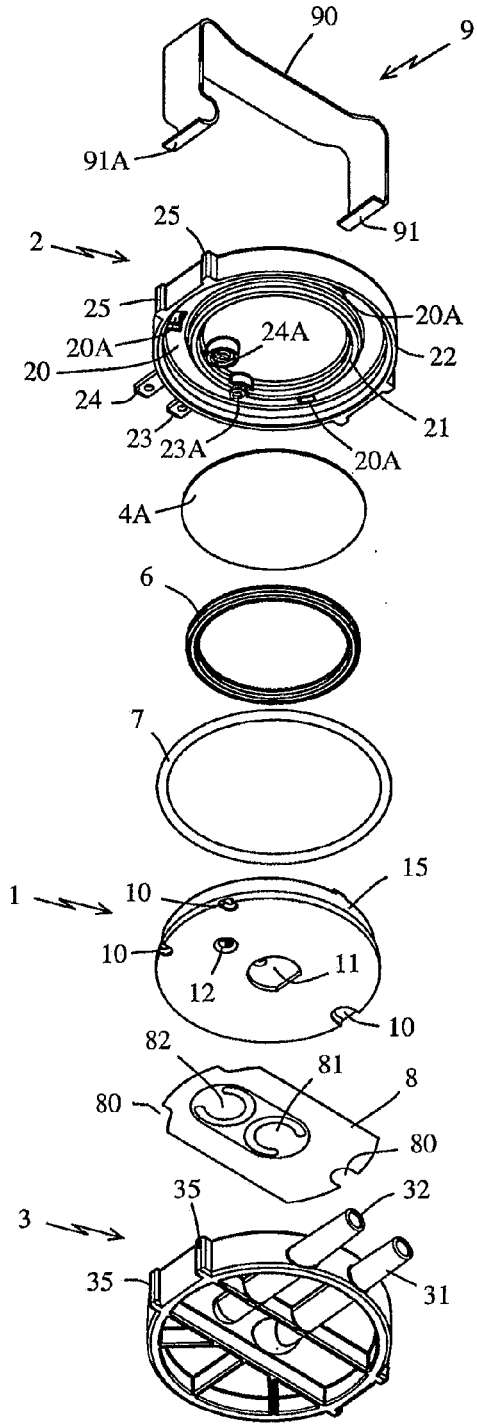

The piezoelectric pump 101, shown separately in FIGS. 2-4, comprises a first casing element consisting of a support 1 made of a plastic reinforced with glass fibers, such as a polyarylamide with 30% glass fiber reinforcement. The support 1 has a circular center zone 1A defining, with a moving wall 4 disposed face to face, a pumping chamber 5, wherein said moving wall advantageously consists of a brass membrane 4 comprising an exterior face oriented toward the exterior of the pumping chamber 5, on which is attached a ceramic piezoelectric actuator 41.

The support 1 is sandwiched between a second and a third casing element made of the same material as the one used for the support 1; said second and third casing elements consisting, respectively, of a lid 2 comprising terminals 23, 24 for supplying electricity to the piezoelectric actuator 41 and of a base plate 3 allowing the circulation of the fluid in the pumping chamber 5.

The terminals 23 and 24 are in contact with a spring 23A contacting the membrane 4 and a spring 24A contacting the piezoelectric actuator 41, respectively, and are powered by an a.c. voltage that brings about a periodic deformation of the piezoelectric actuator 41 in the direction for increasing and then for decreasing the volume of the pumping chamber 5.

The supply voltage for the piezoelectric actuator 41 is preferably provided directly from the household mains via a supply circuit (not shown in the figures) that is not equipped with an isolation transformer. An example of such a supply circuit for the piezoelectric pump is described in French patent application #08 01706.

In order to ensure electrical insulation between the membrane 4 subjected to the mains voltage and the water present in the pumping chamber 5, the bottom face of the membrane 4 is coated with an insulating film 4A consisting of three polyester layers held together by means of an adhesive, in accordance with the solution described in French patent application #08 03520.

As can be more easily discerned in FIGS. 2 and 3, the base plate 3 of the pump 101 comprises a delivery line 31 and a discharge line 32 emerging opposite an inlet 11 and an outlet 12 piercing the support 1, respectively.

The inlet 11 and the outlet 12 are advantageously connected to each other by a channel 13 with a depth of around 1 mm and extending along the top face of the support 1 and defining a dead volume in the pumping chamber 5.

The pumping chamber 5 is laterally delimited by an annular gasket 6 placed in a circular channel 14 formed on the top face of the support 1, the membrane 4 resting on the gasket 6 and having a circular shape with a diameter adapted for engaging precisely between guide ribs 15A borne by a raised centering sleeve 15 on the top face of the support 1. By way of an example, the gasket 6 is a four-lobed seal with an inner diameter of around 22 mm and a height of around 2 mm.

The membrane 4 is held against the gasket 6 by means of the lid 2, the latter comprising a bottom face with a circular rib 21 with a diameter that corresponds to the diameter of the gasket 6 such that the bottom edge of the circular rib 21 is pressed against the exterior face of the membrane 4 opposite the gasket 6. In order to facilitate the deformation of the membrane 4 by means of the piezoelectric actuator 41, the bottom edge of the circular rib 21 advantageously has a convergent, rounded shape.

According to FIGS. 2 and 4, the lid 2 extends radially beyond the rib 21, forming a wall 20 that abuts with the top end of the centering sleeve 15 when the membrane 4 is compressed against the gasket 6, said centering sleeve 15 and said circular rib 21 being dimensioned such that the membrane 4 is located in immediate proximity to the top face of the support 1; for example, at a distance of around 0.1 mm, when the wall 20 of the lid 2 is in abutment with said centering sleeve 15.

The lid 2 is also equipped with a circular, peripheral skirt 22 extending axially towards the support 1 and the bottom edge of which compresses an o-ring gasket 7 resting on a shoulder 16 of the support 1. Said o-ring gasket 7 has the advantage of creating a second seal that ensures the confinement of the liquid in the casing of the pump 101 in case there is a leak around the gasket 6.

According to FIGS. 3 and 4, the positioning of the lid 2 relative to the support 1 is achieved by means of three aligning studs 15B projecting from the top end of the centering sleeve 15 of the support 1, said three aligning studs 15B engaging in corresponding cavities 20A of the bottom face of the lid 2, wherein one of the studs 15B has a greater width for allowing the lid 2 to engage on the support 1 in one direction only.

The positioning of the base plate 3 on the support 1 is in turn achieved by means of bosses 30 borne on the top face of the base plate 3, which engage in corresponding cavities 10 on the bottom face of the support 1, wherein one of the bosses 10 is larger in size for allowing the base plate 3 to engage on the support 1 in one direction only.

The inlet 11 and the outlet 12 of the pumping chamber 5 are equipped with valves 81, 82 formed in a silicone film 8 interposed between the support 1 and the base plate 3, said film comprising cut-outs 80 that engage around the bosses 30 in order to ensure the correct positioning of said film 8 on said base plate 3.

The valve 81, which consists of a horseshoe-shaped cut opposite the inlet 11, closes when the water in the pumping chamber is compressed by the membrane 4 and opens when the piezoelectric actuator 41 bends in the direction for increasing the volume of the pumping chamber 5.

The valve 82, which also consists of a horseshoe-shaped cut opposite the outlet 12, opens when water is compressed in the pumping chamber 5 and closes when the piezoelectric actuator 41 bends in the direction for increasing the volume of the pumping chamber 5.

Figure 5:
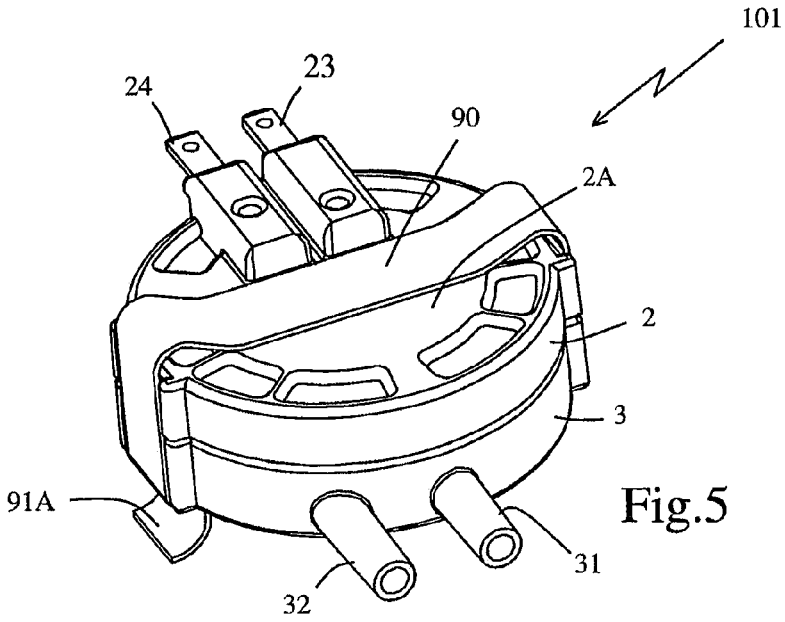
FIG. 5 is a perspective view of the assembled pump of FIG. 2.

More particularly according to the invention and according to FIG. 5, the support 1, the lid 2, and the base plate 3 are held together under stress by means of an elastic clip 9 preferably consisting of a springy metal band with a width of around 8 mm.

The elastic clip 9 has the general shape of a "U", of which the inwardly curved ends form hooks 91 that hook under the base plate 3, the clip 9 comprising a center part 90 that exerts pressure over a whole center zone 2A of the lid 2, thus generating a force in the axis of the circular rib 21 pressing on the periphery of the membrane 4.

The lid 2 and the base plate 3 advantageously comprise guide ribs 25, 35 on their peripheries, said guide ribs 25, 35 delimiting a track in which the elastic clip 9 engages in order to ensure a correct positioning of said clip 9.

According to FIG. 2, the center zone 2A of the lid has a reinforced rigidity so that the pressure exerted by the clip 9 is integrally transmitted via the circular rib 21 to the periphery of the membrane 4 rather than causing the lid 2 to bend. To this end, the lid 2 has a concave bottom face in the center zone 2A delimited by the circular rib 21, the lid 2 exhibiting a thickness of around 1.4 mm in its center and a thickness of around 2 mm near the circular rib 21.

One of the hooks 91 of the clip 9 preferably extends to form an outwardly curved gripping tab 91A that makes it possible to grasp and bend the clip 9, thus making it easier to fasten said clip 9 around the lid 2 and onto the base plate 3, or to remove it therefrom.

The pump 101 thus configured has the advantage of possessing a flexible membrane 4 supporting the piezoelectric actuator 41, the periphery of which is subjected to a substantially constant pressure over time, the elastic clip 9 keeping the lid 2 pressed against the support 1 and the gasket 6. Furthermore, the pressure applied by the clip 9 has the advantage of being equally distributed over the entire periphery of the membrane 4, making it possible to achieve optimum performance of the pump 101.

This particular assembly enables the achievement of a pump that is cheap to manufacture and that exhibits stable performance over time. Lastly, a pump equipped with such a fastening clip also has the advantage that it can be assembled or dismantled quickly, notably for maintenance.

FIGS. 6-9 show a piezoelectric pump 200 according to a second special embodiment of the invention in which the electrical insulation of the pump, and particularly the insulation of the hydraulic part from the part subjected to an electric potential, has been improved.

Figure 6:
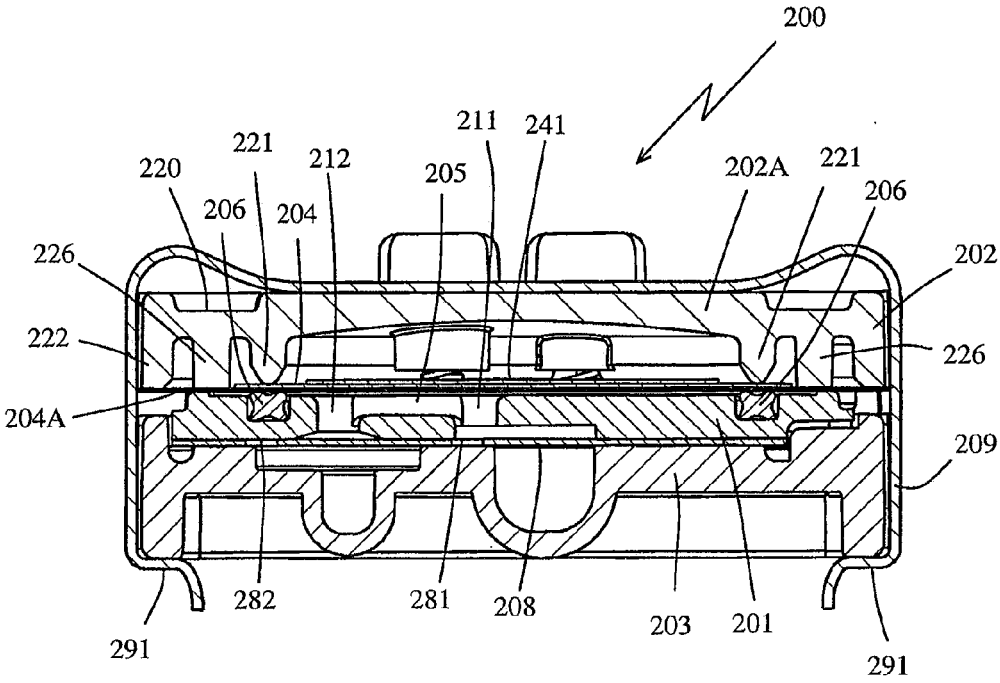
FIG. 6 is a cutaway view of a pump according to a second embodiment of the invention.

According to FIG. 6, the pump 200 comprises a support 201 made of plastic reinforced with glass fibers that comprises a circular center zone defining, with a circular brass membrane 204 attached face to face, a pumping chamber 205.

The support 201 is sandwiched between a lid 202 comprising terminals 223, 224 for supplying electric power to a piezoelectric actuator 241 fastened onto the membrane 204 and a base plate 203 allowing the circulation of fluid in the pumping chamber 205.

The electric terminals 223 and 224 are electrically connected to the membrane 204 and to the piezoelectric actuator 241, and are powered by an a.c. voltage that brings about a periodic deformation of the piezoelectric actuator 241 and of the flexible membrane 204 in the direction for increasing and then for decreasing the volume of the pumping chamber 205.

In order to ensure electrical insulation between the parts of the pump 200 subjected to an electric potential and the liquid contained in the pumping chamber 205, the bottom face of the membrane 204 is coated with an insulating film 204A consisting of three polyester layers held together by means of an adhesive, as described in more detail in French patent application #08 03520. Said insulating film 204A has the shape of a disc with a diameter greater than the diameter of the membrane 204 such that said insulating film 204A comprises a peripheral portion that extends radially beyond the membrane 204 by ca. 5 mm.

The hydraulic coupling of the pump 201 is achieved by means of a delivery line 231 and a discharge line 232 borne by the base plate 203, said delivery 231 and discharge 232 lines emerging opposite an inlet 211 and an outlet 212 piercing the support 201, respectively.

According to FIG. 6, the pumping chamber 205 is laterally delimited by an annular gasket 206 similar to the gasket 6 described for the first embodiment. The gasket 206 is placed in a circular channel 214 formed on the top face of the support 201, which borders the pumping chamber 205 and on which rests the periphery of the membrane 204, the latter having a diameter slightly greater than the diameter of the gasket 206.

The membrane 204 is held against the gasket 206 by means of the lid 202, the latter comprising a bottom face equipped with a raised circular rib 221 having a rounded, convergent bottom edge with a diameter that corresponds to the diameter of the gasket 206 such that said bottom edge of said circular rib 221 presses against the exterior face of the membrane 204 opposite the gasket 206.

The lid 202 extends radially beyond the rib 221 to form a wall 220 successively comprising a second rib 226 and a peripheral skirt 222 that extend coaxially towards the support 201. The second rib 226 and the peripheral skirt 222 each comprise an annular bottom edge on which is glued the peripheral border of the insulating film 204A such that water cannot come into contact with the top part of the membrane 204 in case there is a leak around the gasket 206.

Figure 7:
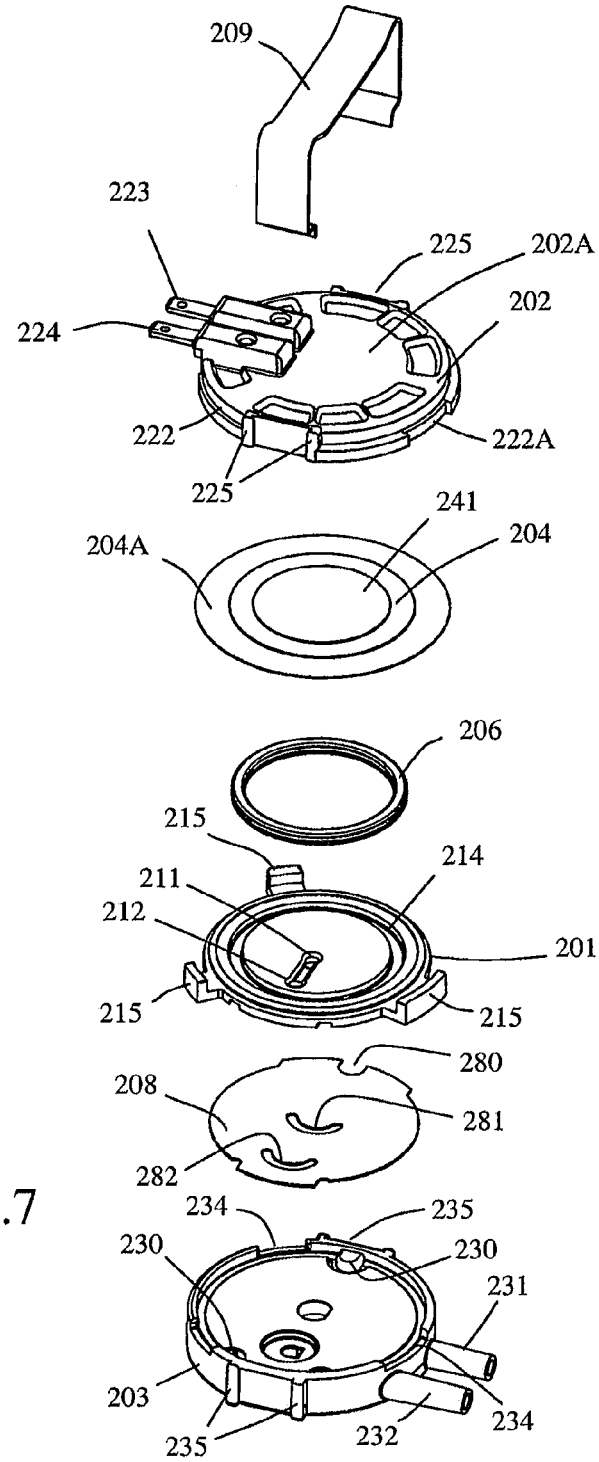
FIG. 7 is an exploded perspective view of the pump of FIG. 6.
Figure 8:
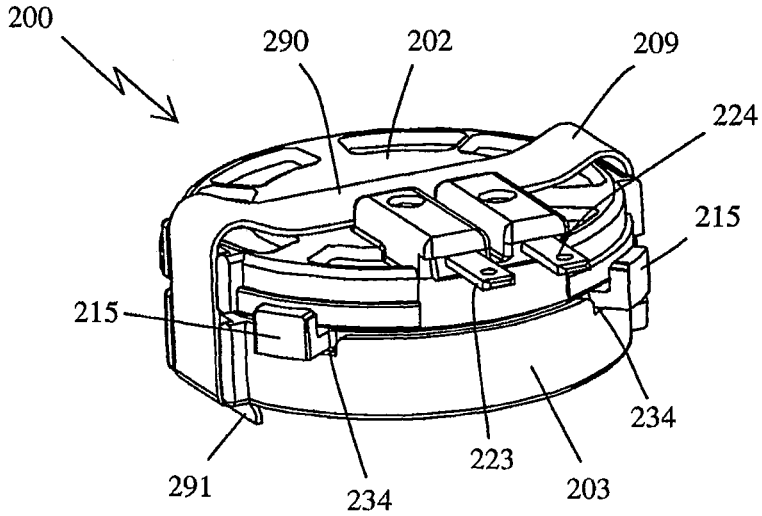
FIGS. 8 and 9 are perspective views of the assembled pump of FIG. 6.
Figure 9:
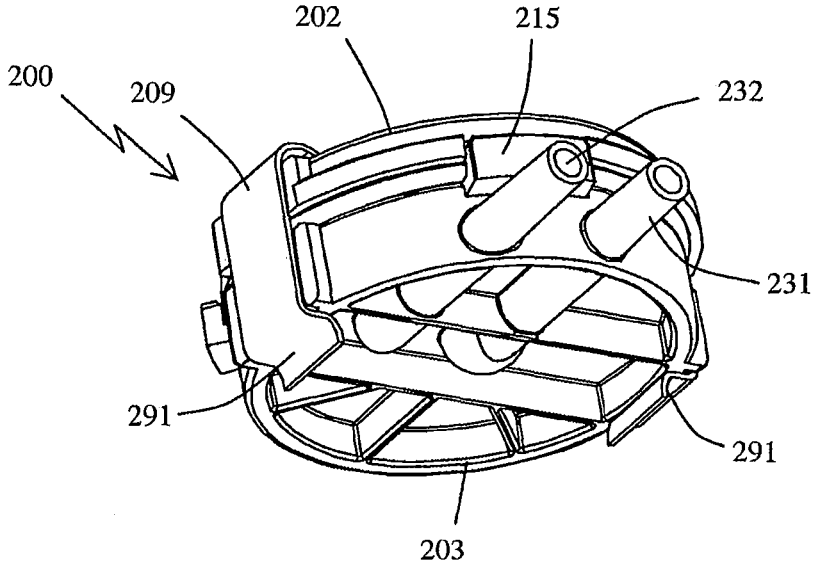

According to FIGS. 7 and 8, the support 201 comprises three centering tabs 215 disposed at 120° relative to each other and projecting radially to the outside, wherein said centering tabs 215 comprise a curved end between which the periphery of the lid 202 engages in order to ensure the centering of said lid 202 on said support 201. One of the centering tabs 215 is advantageously wider and engages in a channel 222A formed at the periphery of the lid 202 for allowing the lid 202 to engage on the support 201 in one direction only.

As can be discerned in FIG. 7, the angular positioning of the base plate 203 on the support 201 is advantageously achieved by insertion of the centering tabs 215 in corresponding notches 234 on the peripheral rim of the base plate 203.

A silicone film 208 is interposed between the support 201 and the base plate 203, wherein the positioning of the film 208 on the base plate 203 is ensured by means of cut-outs 280 formed at the periphery of the film 208, said cut-outs 208 engaging around bosses 230.

The film 208 comprises an arc-shaped cut 282 forming a valve opposite the outlet 212 that opens when water is compressed in the pumping chamber 205 and closes when the piezoelectric actuator 241 bends in the direction for increasing the volume of the pumping chamber 205. The film 208 also comprises an arc-shaped cut 281 opposite the inlet 211 of the support 201, forming a valve that closes when the water in the pumping chamber is compressed by the membrane 204, and that opens when the piezoelectric actuator 241 bends in the direction for increasing the volume of the pumping chamber 205.

The arc-shaped cuts 281 and 282 preferably extend angularly less than 180° and are preferably aligned in the same direction so that a substantial width of material extends between said cuts 281, 282. Such a characteristic makes it possible to achieve good stability of the film 105 in the vicinity of said cuts 281, 282 while particularly reducing the risk of the valve bending during the compression of the film between the support 201 and the base plate 203.

In a manner similar to that of the first embodiment of the invention, the support 201, the lid 202, and the base plate 203 are held together under stress by means of an elastic clip 209 in the shape of a springy metal strip that engages between the guide ribs 225, 235 formed on the periphery of the lid 202 and of the base plate 203, respectively.

The elastic clip 209 has the general shape of a "U", of which the inwardly curved ends form hooks 291 that hook under the base plate 203, the clip 209 comprising a center part 290 that applies an axial pressure over an entire center zone 202A of the lid 202.

According to FIG. 6, the center zone 202A of the lid has a reinforced rigidity so that the pressure exerted by the clip 209 is integrally transmitted via the circular rib 221 to the periphery of the membrane 204 rather than causing the lid 202 to bend.

Like the pump shown in the first embodiment, the pump 201 thus configured has the advantage of possessing a membrane 204 the periphery of which is subjected to a substantially constant pressure over time, wherein the elastic clip 209 keeps the lid 202 pressed against the support 201. Furthermore, the pump according to such an embodiment has the advantage of possessing electrical insulation compliant with the VDE standard in effect in Germany.

Obviously the invention is in no way limited to the embodiment described and illustrated herein, which was provided solely by way of an example. Modifications are still possible, particularly in terms of the constitution of the various elements or by substitution of technological equivalents without in any way exceeding the scope of protection of the invention.

Hence in a variant of embodiment of the invention, the elastic clip could have a different shape by comprising, for example, four branches spaced at 90° relative to each other.

Hence in a variant of embodiment of the invention, the electrical insulation of the piezoelectric element could be achieved by means of an isolation transformer.

The invention claimed is:

1. Piezoelectric pump for a household electric appliance, said piezoelectric pump comprising a moving wall interposed between a first casing element defining a pumping chamber with said moving wall and a second casing element applying pressure against the periphery of the moving wall in order to hold the latter in position, said moving wall comprising an exterior face in contact with a piezoelectric actuator designed to move said moving wall so as to bring about a periodic variation in the volume of the pumping chamber by means of said piezoelectric actuator, the piezoelectric element further comprising a third element covering the first element oppositely disposed relative to the second element, said third element comprising a deliver line and a discharge line communicating with an inlet and an outlet of the pumping chamber, respectively, wherein said first casing element and said second casing element are held together under stress by means of an elastic clip, said elastic clip applying a pressure that tends to compress said first casing element onto second casing element.

2. Piezoelectric pump as in claim 1, wherein a gasket is interposed between said moving wall and said first casing element.

3. Piezoelectric pump as in claim 2, wherein said second casing element comprises a raised portion that presses against the moving wall opposite said gasket, thus sandwiching the periphery of said moving wall between said gasket and said raised portion.

4. Piezoelectric pump as in claim 3, wherein the moving wall comprises a bottom face coated with at least one electrically insulating adhesive film extending radially beyond the moving wall and having a peripheral rim glued onto the second casing element.

5. Piezoelectric pump as in claim 1, wherein said elastic clip comprises a part that applies a pressure on the second casing element opposite the pumping chamber.

6. Piezoelectric pump as in claim 1, wherein said elastic clip comprises at least one end equipped with a gripping tab.

7. Piezoelectric pump as in claim 1, wherein said elastic clip consists of a springy metal band.

8. Piezoelectric pump as in claim 1, wherein said first and second casing elements comprise complementary shapes that ensure their relative positioning during the assembly of the pump by means of the elastic clip.

9. Piezoelectric pump as in claim 1, wherein said first and third elements comprise complementary shapes that ensure their relative positioning during the assembly of the piezoelectric pump by means of the elastic clip.

10. Piezoelectric pump as in claim 9, wherein said elastic clip presses on the second and third elements.

11. Clothing iron comprising means for supplying water to a spray nozzle or to a vaporization chamber, wherein said supply means comprises the piezoelectric pump as in claim 1.

* * * * *

UNITED STATES PATENT AND TRADEMARK OFFICE

CERTIFICATE OF CORRECTION

PATENT NO. : 8,522,462 B2
APPLICATION NO. : 13/139071
DATED : September 3, 2013
INVENTOR(S) : Andrea Lukas et al.

It is certified that error appears in the above-identified patent and that said Letters Patent is hereby corrected as shown below:

Title Page:

Column 2, Item (57) Abstract, Line 9, delete “actuator” and insert -- actuator, --

In the Claims:

Column 7, Line 27, Claim 1, delete “deliver” and insert -- delivery --

Signed and Sealed this
Twenty-eighth Day of January, 2014

Michelle K. Lee

Michelle K. Lee
*Deputy Director of the United States Patent and Trademark Office*

UNITED STATES PATENT AND TRADEMARK OFFICE

CERTIFICATE OF CORRECTION

PATENT NO. : 8,522,462 B2
APPLICATION NO. : 13/139071
DATED : September 3, 2013
INVENTOR(S) : Lukas et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 144 days.

Signed and Sealed this
Fifteenth Day of September, 2015

Michelle K. Lee

Michelle K. Lee
*Director of the United States Patent and Trademark Office*